US005711620A

United States Patent [19]

Sasaki et al.

[11] Patent Number: 5,711,620

[45] Date of Patent: Jan. 27, 1998

[54] COLOR THERMAL PRINTER

[75] Inventors: Hidemi Sasaki; Kenichi Shiba; Satoru Goto, all of Asaka, Japan

[73] Assignee: Fuji Photo Film Co., Ltd., Kanagawa, Japan

[21] Appl. No.: 723,951

[22] Filed: Sep. 26, 1996

[30] Foreign Application Priority Data

Sep. 28, 1995 [JP] Japan ..... 7-250488

[51] Int. Cl.[6] ..... B41J 11/00; B41J 2/315

[52] U.S. Cl. ..... 400/120.02; 400/582; 400/618; 347/173

[58] Field of Search ..... 400/120.02, 582, 400/596, 618; 347/173

[56] References Cited

U.S. PATENT DOCUMENTS

| | | | |
|---|---|---|---|
| 5,156,467 | 10/1992 | Kitahara et al. | 400/58 |
| 5,486,057 | 1/1996 | Skinner et al. | 400/120.02 |
| 5,585,832 | 12/1996 | Orimoto et al. | 347/175 |

FOREIGN PATENT DOCUMENTS

| | | | |
|---|---|---|---|
| 0011181 | 1/1983 | Japan | 400/120 |
| 6-96338 | 6/1986 | Japan . | |
| 61-132379 | 6/1986 | Japan . | |
| 0264885 | 10/1989 | Japan | 400/120 |
| 4-4163 (A) | 1/1992 | Japan | 400/120 |
| 5-201043 | 8/1993 | Japan . | |

*Primary Examiner*—John S. Hilten

[57] ABSTRACT

In a one-pass multi-head type color thermal printer, a color recording material is transported by a plurality of feed roller pairs, each of which consists of a capstan roller and a pinch roller and is disposed behind one of a plurality of thermal heads. The pinch roller is movable relative to the capstan roller to nip the recording material, and the capstan roller is driven each individually to transport the recording material at an appropriate speed through each of the thermal heads. A platen roller is disposed in opposition to each of the thermal head so as to be movable to and from the opposed thermal head, whereas the thermal heads are mounted stationary.

18 Claims, 7 Drawing Sheets

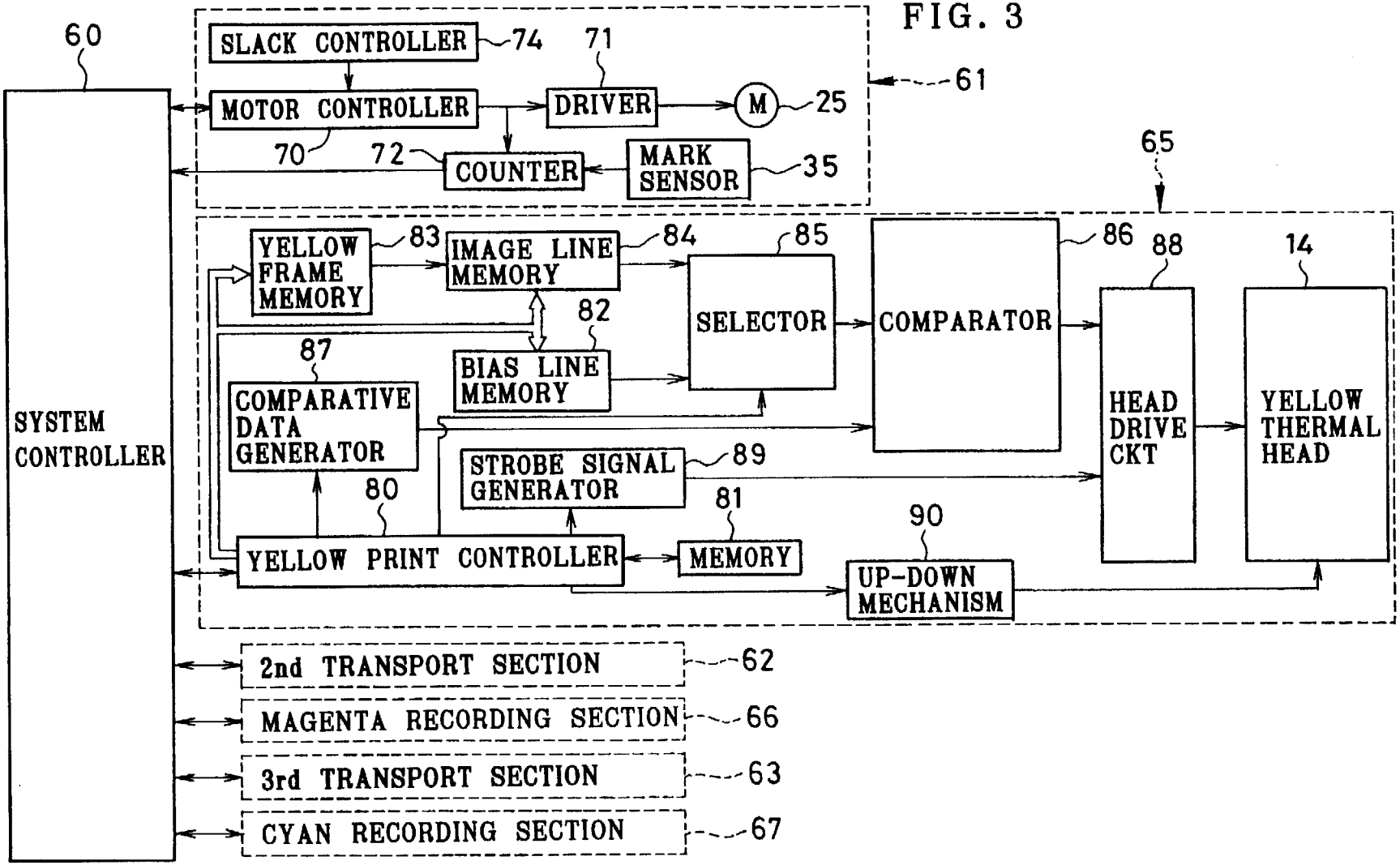
FIG. 3
61
65
SLACK CONTROLLER
74
MOTOR CONTROLLER
70
DRIVER
71
M
25
COUNTER
72
MARK SENSOR
35
YELLOW FRAME MEMORY
83
IMAGE LINE MEMORY
84
BIAS LINE MEMORY
82
SELECTOR
85
COMPARATOR
86
COMPARATIVE DATA GENERATOR
87
HEAD DRIVE CKT
88
YELLOW THERMAL HEAD
14
STROBE SIGNAL GENERATOR
89
YELLOW PRINT CONTROLLER
80
MEMORY
81
UP-DOWN MECHANISM
90
2nd TRANSPORT SECTION
62
MAGENTA RECORDING SECTION
66
3rd TRANSPORT SECTION
63
CYAN RECORDING SECTION
67
SYSTEM CONTROLLER
60

COLOR THERMAL PRINTER

BACKGROUND OF THE INVENTION

1. Field of the Invention

The present invention relates to a color thermal printer which has plural thermal heads and platens arranged along a one-way path of a recording material, and more particularly to a color thermal printer which minimizes color registration error that can occur due to fluctuation of load applied on the recording material during transportation.

2. Background Arts

There are many types of color thermal printers, which are mainly classified into thermal transfer type such as ink transfer type and wax transfer type, and direct printing type using a thermosensitive recording material. A color thermosensitive recording material includes cyan, magenta and yellow recording layers which have different thermal sensitivities and develop respective colors in different heat energy ranges.

There is a one-pass multi-head type color thermal printer which has a plurality of, e.g. three thermal heads and in which a color recording material, e.g. the color thermosensitive material, is passed for one time through the thermal heads, for example, as disclosed in JPA 5-201043 and JPB 6-96338. The one-pass multi-head type has an advantage in that it takes a shorter time to print a full-color image, compared with a one-head three-pass type color thermal printer in which a sheet of color recording material is passed three times through a single thermal head to record a full-color image.

The thermal heads are each individually movable between a retracted position away from the recording material and an actuating position contacting the recording material and pressing it onto the platen roller. While a designated recording area for an image is transported through the thermal head, the thermal head is set in the actuating position to effect recording.

Since the load on the recording material rapidly increases at the moment when the thermal head comes into contact with the recording sheet, the transporting speed of the recording material is lowered temporarily, which can cause a color registration error. The transporting speed can fluctuate due to other reasons such as synchronization failure of rollers of the transporting system.

On the other hand, in the field of digital image printing, since the solving power is remarkably improved in the signal processing side and the recording material side as well, the digital image is more and more required to have a high quality that is comparable to the silver salt photographs. For example, the conventional quality level of digital printing has been at most 8 dots/mm and 32 tones in gradation, while the recent requirement is 12–16 dots/mm and 256 tones. The one-pass three-head type printer is suitable for printing such a high quality image at a high speed, but it is necessary to transport the recording material stably and accurately.

SUMMARY OF THE INVENTION

A prime object of the present invention is to provide a one-pass three-head type thermal printer which can feed the recording material stably and accurately to provide a high quality image, while preventing color registration error but maintaining a high printing speed.

To achieve the above and other objects and advantages, in a color thermal printer for printing a full-color image on a recording material, which has a plurality of thermal heads arranged in series along a transport path, each of the plurality of thermal heads recording a particular color frame of the full-color image on the recording material to print the full-color image while the recording material being advanced in a transporting direction at one time through the transport path, the present invention provide the color thermal printer with a plurality of platens, each being opposed to one of the plurality of thermal heads across the transport path, and movable relative to the opposed thermal head to press the recording material against the opposed thermal head; a plurality of capstan rollers disposed respectively behind the plurality of thermal heads in the transporting direction of the recording material; a plurality of pinch rollers, each being opposed to one of the capstan rollers across the transport path, and movable relative to the opposed capstan roller to nip the recording material; and driving means for driving the capstan rollers each individually to transport the recording material at an appropriate speed through each of the plurality of thermal heads.

Transporting the recording material by use of the capstan rollers permits accurate positioning of the recording material relative to the thermal heads, and thus prevents color registration error even in a high quality image of 12–16 dots/mm and 256 tones.

When the color thermal printer is of a type wherein the recording material has a length extending over the plurality of thermal heads, to permit recording the full-color image in one of recording areas disposed successively along the recording material; and wherein the plurality of thermal heads are sequentially pressed onto the recording material prior to starting recording the particular color frames from a leading end of each of the recording areas, and are sequentially removed away from the recording material after terminating recording the particular color frames at a trailing end of the each recording area, it is preferable that the color thermal printer is further provided with slack forming means for forming a slack in the recording material in an upstream portion of the transport path before each of the plurality of thermal heads. In this way, even though the load on the recording sheet changes each time the recording material is brought into contact with the thermal head, the load change is absorbed by the slack so as not to affect the recording of the next thermal head.

According to a preferred embodiment, the slack forming means comprises the capstan rollers, the driving means and sensors for detecting conditions of the recording material in the transport path, and wherein the driving means controls driving of the capstan rollers based on output signals from the sensors.

It is also preferable that the plurality of thermal heads are mounted stationary, whereas the platens are mounted movable between an actuating position contacting with the opposed thermal head each and a retracted position away from the opposed thermal head. This embodiment minimizes possible deviation of the thermal heads from proper position relative to the recording material.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein:

FIG. 3 is a block diagram of the circuitry of the printer shown in FIG. 1;

DETAILED DESCRIPTION OF THE PREFERRED EMBODIMENT

Figure 1:
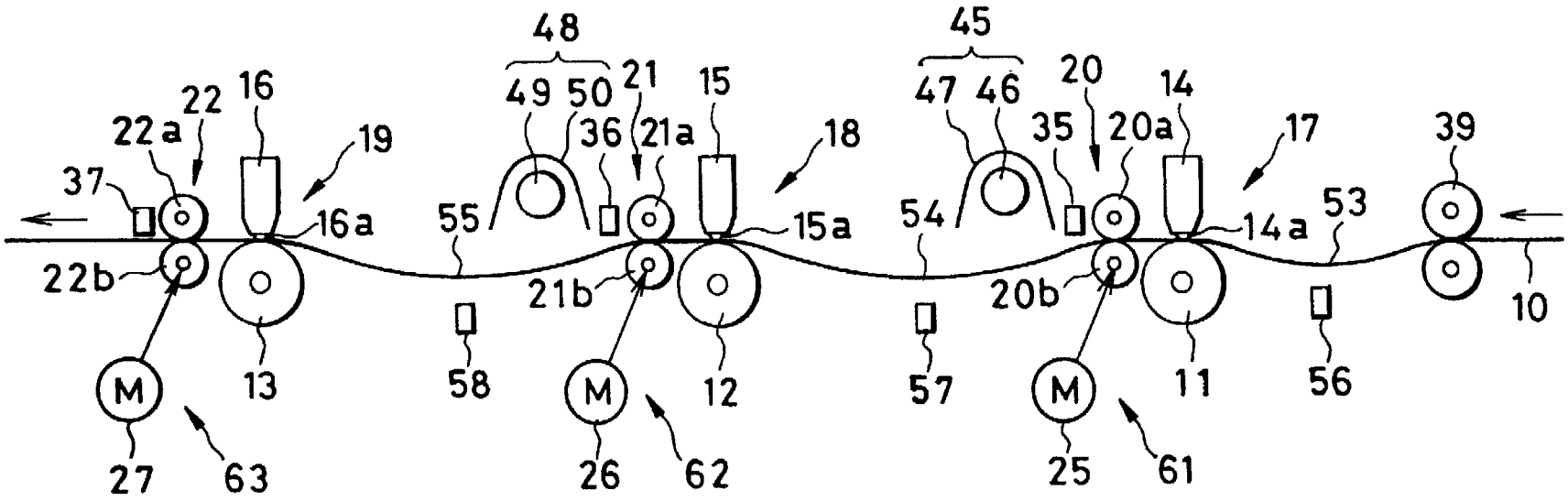
FIG. 1 is a schematic diagram illustrating a one-pass three-head type direct color thermal printer according to an embodiment of the present invention.

In the thermal printer of FIG. 1, three platen rollers 11, 12 and 13 are disposed at appropriate intervals along a transport path of a color thermosensitive recording material 10, hereinafter referred to as a recording material 10. In opposition to the platen rollers 11 to 13, a yellow thermal head 14, a magenta thermal head 15 and a cyan thermal head 16 are disposed to provide a yellow printing stage 17, a magenta printing stage 18 and a cyan printing stage 19, respectively. Behind and proximate the respective platen rollers 11 to 13 with respect to a transporting direction of the recording material 10, there are disposed feed roller pairs 20, 21 and 22. Each pair consists of a pinch roller 20*a*, 21*a* or 22*a* and a capstan roller 20*b*, 21*b* and 22*b*. The capstan rollers 20*b*, 21*b* and 22*b* are each individually driven to rotate by pulse motors 25, 26 and 27, to withdraw the recording material 10 from a not-shown roll and feed it sequentially to the thermal heads 14 to 16.

Figure 2:
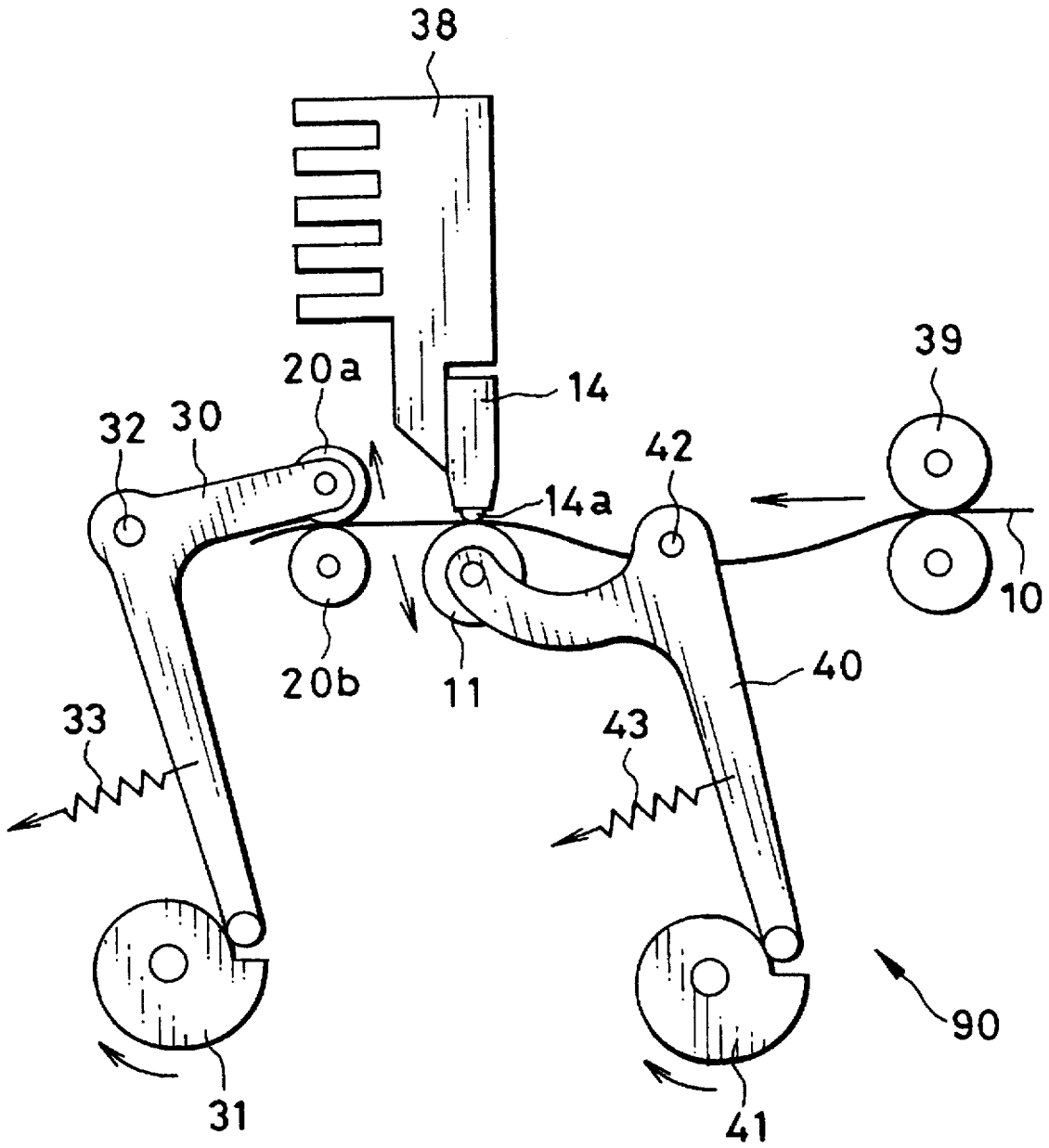
FIG. 2 is an enlarged explanatory diagram illustrating a yellow printing stage of the printer shown in FIG. 1.

The capstan roller 20*b* is mounted horizontally to a not-shown fixed frame, while the pinch roller 20*a* is mounted horizontally to a swinging arm 30, as shown in FIG. 2. The swinging arm 30 can swing about an axle 32 through a given angle in cooperation with a cam 31. The swinging arm 30 is urged by a coil spring 33 to press the pinch roller 20*a* against the capstan roller 20*b*. In this way, the pinch roller 20*a* is in tight contact with the capstan roller 20*b* while the cam 31 is in a position shown in FIG. 2. To pass a leading end of the recording material 10, the cam 31 is rotated by a given angle to remove the pinch roller 20*a* from the capstan roller 20*b*. The other feed roller pairs 21 and 22 have the same construction as the feed roller pair 20.

As shown in FIG. 1, a mark sensor 35 is disposed behind and proximate the feed roller pair 20. The mark sensor 35 is a reflective sensor having a light projector and a light receptor, to detect positioning marks which are formed at regular intervals in margins out of recording areas of the recording material 10. Counting drive pulses applied to the pulse motor 25 from the time of detection of each positioning mark, the present position of the recording material 10 and thus a start position of each recording area can be determined. The detection signal from the mark sensor 35 is also used for controlling driving the thermal head 14. In the same way, mark sensors 36 and 37 are disposed behind the thermal heads 15 and 16, to determine the star position of the recording area in the magenta and the cyan printing stages 18 and 19, respectively. Although the positioning marks are assumed to be formed on an obverse side of the recording material 10 on which the thermal heads 14 to 16 are contacted, it is possible to provide the positioning marks on the reverse side. The positioning marks may be provided previously by another printing process, or immediately before the color image printing by use of a specific thermal head. It is alternatively possible to provide holes or notches as positioning marks. In that case, another type of mark sensors suitable for detecting holes or notches should be used.

The thermal heads 14 to 16 have a heating element array 14*a*, 15*a* and 16*a* each, which consists of a great number of heating elements and extends in a main scanning direction that is an axial direction of the platen rollers 11 to 13. As shown in FIG. 2, the thermal head 14 has a heat radiator or cooling fin 38. The thermal heads 15 and 16 have the same construction as the thermal head 14.

The platen roller 11 is also mounted horizontally to a swinging arm 40, as shown in FIG. 2. The swinging arm 40 can swing about an axle 42 through a given angle in cooperation with a cam 41. The swinging arm 40 is urged by a coil spring 43 to press the platen roller 11 against the heating element array 14*a* of the thermal head 14. In this way, the platen roller 11 is in contact with the heating element array 14*a* while the cam 41 is in a position shown in FIG. 2. To pass a leading end of the recording material 10, or at the trailing end of each recording area, the cam 41 is rotated by a given angle to remove the platen roller 11 from the thermal head 14. The other platen rollers 12 and 13 have the same construction as the platen roller 11.

The cams 31 and 41, and not shown cams for the magenta and cyan printing stages 18 and 19 are controlled with respect to the detection signal from the mark sensors 35, 36 and 37.

As shown in FIG. 1, an optical fixing device 45 for yellow is disposed between the yellow thermal head 14 and the magenta thermal head 15. The optical fixing device 45 consists of a lamp 46 radiating ultraviolet rays having an emission peak at 420 nm, and a reflector 35. An optical fixing device 48 for magenta is disposed between the magenta thermal head 15 and the cyan thermal head 16. The optical fixing device 48 consists of a lamp 49 radiating near-ultraviolet rays having an emission peak at 365 nm, and a reflector 50.

Before the respective thermal heads 14 to 16 with respect to the transporting direction, the recording material 10 has slacks 53, 54 and 55, respectively. The slacks 53 are respectively formed by not rotating the capstan rollers 20*b*, 21*b* and 22*b* for a given time when the feed roller pairs 20 to 22 first nip the leading end of the recording material 10. The feed roller pairs 20 to 22 do not start rotating until the slacks 53 to 55 have a predetermined magnitude or length, respectively. The amounts or lengths of the slacks 53 to 55 are always monitored by slack sensors 56, 57 and 58, respectively. For example, a detection signal from the slack sensor 56 is sent to a slack controller 74 (see FIG. 3), which controls the length of the slack 53 to be constant. The slack sensors 56 to 58 may be micro-displacement gages. In place of the micro-displacement gages, it is possible to provide dancer rollers so as to move with the change in the amount the slacks 53 to 55, and detect the amount of movement of the dancer rollers as representative of the slack amount.

Referring to FIG. 3 showing the circuitry of the thermal printer, a system controller 60 sequentially controls first to third transport sections 61, 62 and 63, and yellow, magenta and cyan recording sections 65, 66 and 67. The first transport section 61 is to transport the recording material 10 for the yellow frame recording, the second transport section 62 is to transport the recording material 10 for the magenta frame recording, the third transport section 63 is to transport the recording material 10 for the cyan frame recording. The system controller 60 controls start and stop of the pulse motor 25 through a motor controller 70 of the first transport section 61. The motor controller 70 outputs motor drive pulses with a constant cycle to a motor driver 71, thereby to rotate the pulse motor 25 at a constant speed.

A counter 72 starts counting the motor drive pulses from the time when the mark sensor 35 detects the leading end of the recording material 10, and sends the count to the system controller 60. The system controller 60 determines the start position of each recording area based on the count, and determines when to bring the recording material 10 into contact with the heating element array 14*a*, as well as when to activate the heating elements of the array 14*a*. The second and third transport sections 62 and 63 have the same construction as the first transport section 61.

The system controller 60 outputs commands for controlling up-down movement of the platen rollers 11 to 13 and a line print start signal for each of the thermal heads 14 to 16 to the yellow, magenta and cyan recording sections 65 to 67 with reference to the counts of the counters of the first to third transport sections 61 to 63, respectively.

In the yellow recording section 65, a yellow print controller 80 starts printing one line of the yellow frame in response to the line print start signal. The yellow print controller 80 also counts the line print start signal to determine the number of lines having been printed.

A memory 81 stores bias data and other data necessary for yellow frame recording. The bias data is commonly used for every heating elements of the yellow thermal head 14. Based on the common bias data, bias data of one line is formed. A bias line memory 82 is revised each time the bias data changes. Unless the bias line memory 82 is revised, the same bias data is used for each line. However, as the heating elements have inevitable variations in resistance, heat energy generated from the heating elements can differ from one another in response to the same drive pulses. Therefore, it is desirable to determine bias data individually to each heating element so as to compensate for the resistance variation.

A yellow frame memory 83 stores yellow image data per frame, which is entered through a video camera, an image scanner or the like. The yellow frame memory 83 is read line by line during the yellow frame recording. The yellow image data per line is sequentially written in an image line memory 84. Alternatively, it is possible to write blue frame data in a frame memory and convert it line by line into yellow image data while reading it line by line from the frame memory.

A selector 85 first selects the bias line memory 82 to serially send the bias data of one line to a comparator 86 in the order of the pixels. Next, the selector 85 selects the image line memory 84 to serially send the yellow image data of one line to the comparator 86.

A comparative data generator 87 generates a series of comparative data to the comparator 86. If the image data have 256 tonal steps, the series of comparative data is from "0" to "255" in decimal notation. The comparator 76 compares the bias data and the image data with the comparative data. As a result, the bias data is converted into 256-bit bias drive data per one pixel.

A head drive circuit 88 provides logical products of the drive data from the comparator 76 and strobe pulses from a strobe signal generator 89. Thus, a drive pulse having the same width as the strobe pulse is generated when the binary drive data has a value "1". When the binary drive data has a value "0", no drive pulse is generated. The width of the strobe pulse varies depending upon whether it is for bias heating or image heating, and according to color to be printed, i.e., depending upon the thermal sensitivities of recording layers of the recording material 10. But generally, the strobe pulse has a larger width for bias heading than for image heating.

An up-down mechanism 90 is constituted of the platen roller 11, the swinging arm 40 and the cam 41, and moves the platen roller 11 between the actuating position contacting the thermal head 14 and the retracted position away from the thermal head 14. Electric power starts being supplied to the heating element array 14*a* of the thermal head 14 in a predetermined time after the recording sheet 10 comes into contact with the heating element array 14*a*. The time is necessary for the transport condition to be stable. Also, the platen drum 11 and thus the recording material 10 are not removed from the heating element array 14*a* until the recording material 10 has been transported by a predetermined number of lines since the power supply to the heating element array 14*a* is terminated. Because the magenta and cyan recording sections 66 and 67 have the same construction as the yellow recording section 65, and operate in the same way as the yellow recording section 65, the detailed description relating to the magenta and cyan recording sections 66 and 67 are omitted.

Figure 4:
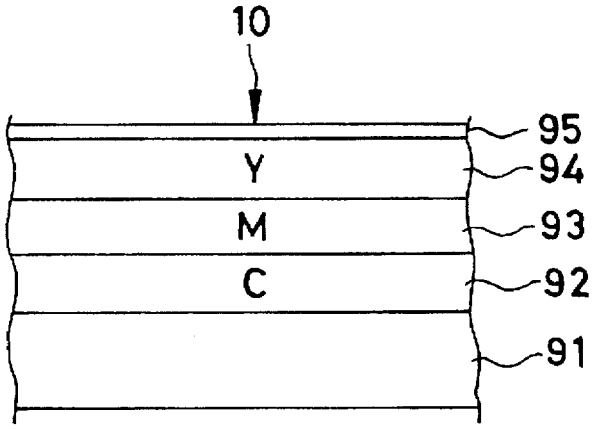
FIG. 4 is an explanatory diagram illustrating a multi-layered structure of a color thermosensitive recording material.

FIG. 4 shows an example of layered structure of the recording material 10, wherein a thermosensitive cyan layer 92, a thermosensitive magenta recording layer 93, a thermosensitive yellow recording layer 94 and a protection layer 95 are formed on a base material 91 in this order from reverse to obverse. For the sake of clarity, "C", "M" and "Y" are shown in the thermosensitive cyan, magenta and yellow recording layers 92 to 94, respectively. The closer to the obverse, the recording layers 92 to 94 have the higher thermal sensitivities. The order of recording to the recording layers 92 to 94 is from the higher to the lower thermal sensitivity, that is, from the obverse to the reverse side. Therefore, if the recording material 10 has a structure where a magenta recording layer is formed on atop of a yellow recording layer, then the magenta frame recording is made prior to the yellow frame recording.

Between the respective recording layers 92 to 94, there are formed intermediate layers for adjusting the thermal sensitivities of the magenta and cyan recording layers 93 and 92, though such intermediate layers are not shown in the drawings. As the base material 91, an opaque coating paper or plastic film is used. But when making a print for use in an over head projector, a transparent plastic film is used instead.

The cyan recording layer 92 contains an electron donating dye precursor and an electron accepting compound s main components, and is colored cyan when it is heated. The magenta recording layer 93 contains a diazonium salt compound having a maximum absorption factor at a wavelength range around 365 nm, and a coupler which acts upon the diazonium salt compound, and is developed in magenta when it is heated. The magenta recording layer 93 loses its coloring ability when it is exposed to near-ultraviolet rays of about 365 nm, because the diazonium salt compound is photochemically decomposed by this range of rays. The yellow recording layer 94 contains a second diazonium salt compound having a maximum absorption factor at a wavelength range around 420 nm, and a coupler which acts upon the second diazonium salt compound, and is developed in yellow when it is heated. The yellow recording layer 94 loses its coloring ability when it is exposed to ultraviolet rays of about 420 nm, because the second diazonium salt compound is photochemically decomposed by this range of rays.

Figure 5:
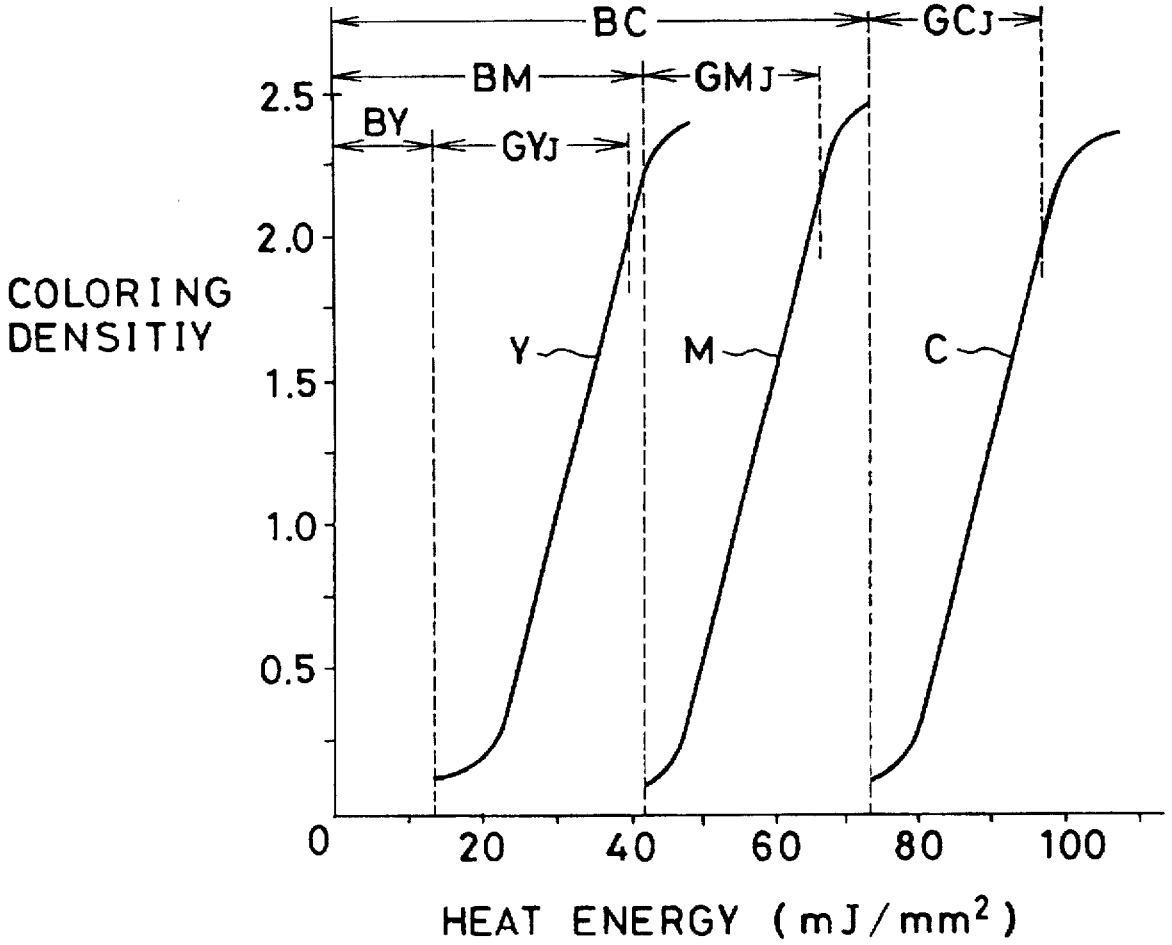
FIG. 5 is a graph showing the coloring properties of the color thermosensitive recording material.

As shown in FIG. 5, the yellow recording layer 94 requires a smallest heat energy for coloring, whereas the cyan recording layer 92 requires a largest heat energy for coloring. For the yellow recording layer 94, the coloring heat energy applied thereto is a sum of a constant bias heat energy BY and a variable image heat energy GYj that is determined by a gradation level or tonal step "J" of each pixel. The bias head energy BY is to heat the yellow recording layer 94 up to a temperature at which it is about to be colored. Also, the coloring heat energy for the magenta recording layer 93 is a sum of a given bias heat energy BM and a variable image heat energy GMj, and the coloring heat energy for the cyan recording layer 92 is a sum of a given bias heat energy BC and a variable image heat energy GCj.

Now the operation of the thermal printer as set forth above will be described.

First, three color separation frames of a full-color image are written in the respective color frame memories. Thereafter a print start switch (not shown) is turned on, the system controller 60 turns the optical fixing devices 45 and 48 on, and causes feed rollers 39 of a paper supply mechanism to feed out the recording material 10. When the leading end of the recording material 10 is detected by the mark sensor 35, the pinch roller 20*a* of the first feed roller pair 20 is moved down to nip the recording material 10 with the capstan roller 20*b*. After the given time necessary for forming the slack 53, the system controller 60 starts the motor controller 70 supplying the motor drive pulses to rotate the pulse motor 25 and thus the capstan roller 20*b* of the first feed roller pair 20 at a constant speed.

The counter 72 starts counting the motor drive pulses each time the positioning mark is detected. As a not-shown memory of the system controller 60 is previously written with data of the distance from the positioning mark to the leading end of each recording area, the system controller 60 determines based on the count of the counter 72 when to bring the recording sheet 10 into contact with the heating element array 14*a* of the thermal head 14, and when to drive the thermal head 14 to start recording. Under the control of the system controller 60, the yellow print controller 80 actuates the up-down mechanism 90 to move the platen roller 11 up to press the recording material 10 against the heating element array 14*a*. Thereafter, the yellow print controller 80 reads the yellow image data of the first line serially from the yellow frame memory 83 and write it in the image line memory 84. The yellow print controller 80 also reads the bias data from the memory 81 and write it in the bias line memory 82.

When it is determined based on the count of the counter 72 that the leading end of the recording area is located under the heating element array 14*a*, the system controller 60 lets the yellow print controller 70 read bias data from the bias line memory 82 to produce bias drive pulses for the first line through the comparator 86 and the drive circuit 88, to make bias-heating of the heating element array 14*a*. Next, the yellow print controller 80 produces image drive pulses for the first line of the yellow frame based on the yellow image data by use of the image line memory 84, the comparator 86 and the drive circuit 88, to make image-heating of the heating element array 14*a*. Thus, the heating elements of the array 14*a* each individually radiate a heat energy consisting of the constant bias heat energy BY and the image heat energy GYj variable according to the yellow image data of each pixel. In this way, the yellow recording layer 94 develops yellow dots at different densities between pixels, according to the coloring properties shown in FIG. 5. The second and following lines of the yellow frame are recorded in the same way as above.

In the present embodiment, the thermal head 14 is not driven during a period from the contact with the recording material 10 to the location of the leading end of the recording area under the heating element array 14*a*. However, it is preferable to start bias-heating during that period, for reducing change in the load necessary for transporting the recording material 10.

While the thermal head 14 conducts yellow frame recording, the feed roller pair 20 feeds the recording material 10 at the constant speed toward the next printing stage 18. While the recording material 10 is being moved under the optical fixing device 45, the yellow recording layer 94 is fixed by the ultraviolet rays of 420 nm.

Since the recording material 10 is continuously fed to the printing stages 17 to 19 in the one-pass type printer, the thermal head 14 after terminating the yellow frame recording starts recording the next yellow frame of the next full-color image to be printed when the leading end of the next recording area of the recording material 10 is moved in under the heating element array 14*a*

The slack controller 74 changes the rotational speeds of the motor 25 with reference to the signal from the slack sensor 56 so as to maintain the amount of the slack 53 constant. The speed change operation is preferably executed in those periods while the recording areas are not located under the heating element array 14*a*.

In the same way as for the above yellow printing stage 17, the system controller 60 controls the second transport section 62 and the magenta recording section 66 based on the detection signal from the mark sensor 36, to form the slack 54 and conduct recording a magenta frame line by line to the magenta recording layer 93 in the magenta printing stage 18. The magenta recording layer 93 is thereafter fixed by the ultraviolet rays of about 365 nm from the optical fixing device 48. The system controller 60 controls the third transport section 63 and the cyan recording section 67 such that the slack 55 is formed and a cyan frame is recorded line by line to the cyan recording layer 92 in the cyan printing stage 19.

It is alternatively possible to form the slacks 53 to 55 by decelerating the transport speed of the feed roller pairs 20 to 22 during only the first or initial frame recording in the respective printing stages 17 to 19, compared with the ordinary constant transport speed. The full-color images thus recorded successively on the recording material 10 are cut into pieces. It is preferable to provide a slack or loop in a downstream portion behind the third feed roller pair 22, so that the cyan frame recording may not be affected by a change in the transportation load on the recording material 10 that may be caused by the cutting.

As described so far, the platen rollers 11 to 13 are moved up to press the recording material 10 against the thermal heads 14 to 16, respectively when a predetermined position proximate the leading end of the recording area is located under the thermal heads 14 to 16. And the platen rollers 11 to 13 are moved down to remove the recording material 10 from the thermal heads 14 to 16, respectively when the recording material 10 has been advanced by a length corresponding to several lines. That is, the magenta thermal head 15 can come into contact with the recording material 10 while the yellow thermal head 14 is recording. Even though the load on the recording material 10 changes at the contact and the removal of any of the thermal heads 14 to 16, the load change is absorbed by any of the slacks 54 to 55, so that it does not adversely affect the recording in the next printing stage.

Figure 6:
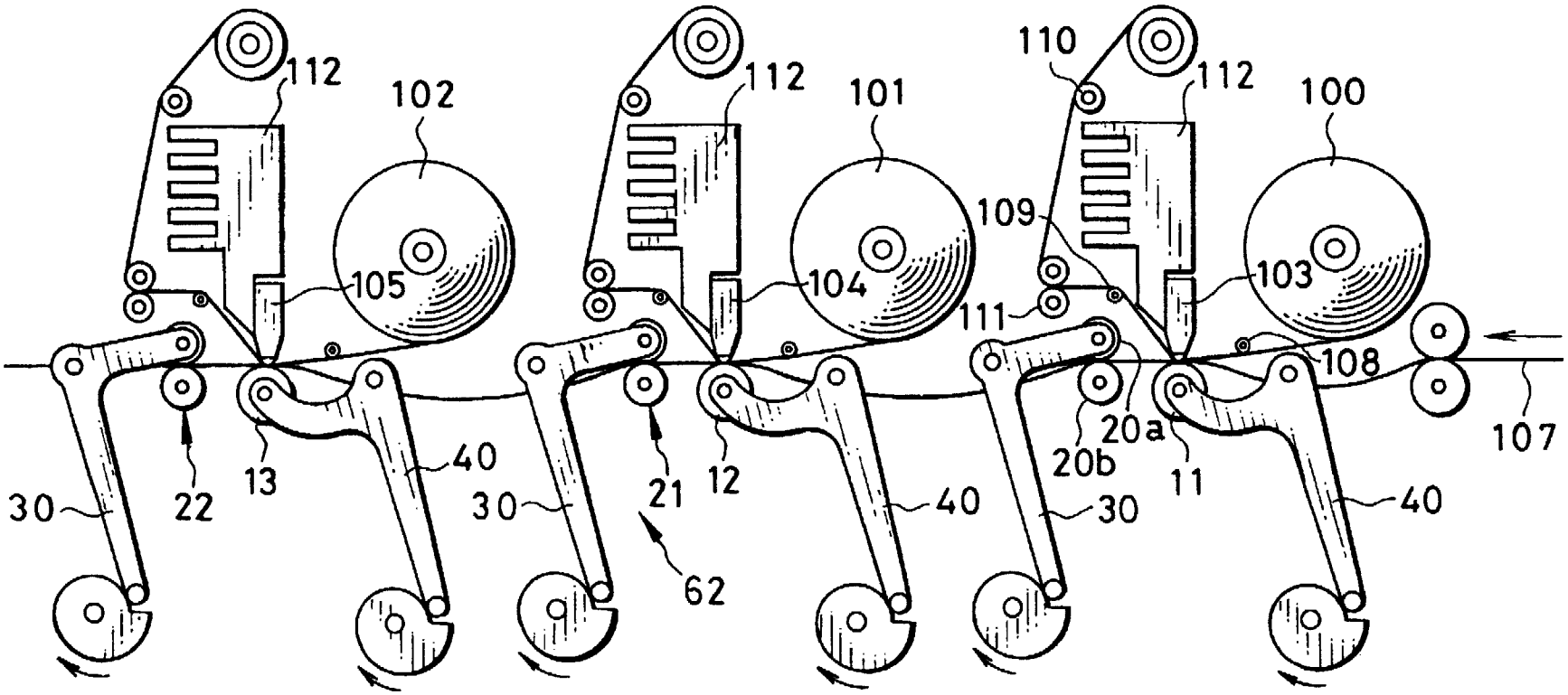
FIG. 6 is a schematic diagram illustrating a one-pass three-head type thermal color ink transfer printer according to another embodiment of the present invention.

Although the present invention has been described with respect to the direct color printer, the present invention is of course applicable to thermal transfer type color printers. For example, as shown in FIG. 6, yellow, magenta and cyan ink ribbons 100, 101 and 102 are inserted in between heating element arrays of thermal heads 103, 104 and 105 and an appropriate recording material 107, to thermally transfer the yellow, magenta and cyan inks to the recording material 107. The yellow ink ribbon 100 is guided through rollers 108, 109 and 110, and is transported by rollers 111. The magenta and cyan ink ribbon 101 and 102 are guided and transported in the same way. Designated by 112 are heat radiators or cooling fins for the respective thermal heads 103 to 105. Other elements may be equivalent to those designated by the same reference numbers in the embodiment shown in FIG. 1. It is possible to provide a fourth printing stage to use a black ink ribbon in addition to the three color ink ribbons 100 to 102.

Figure 7:
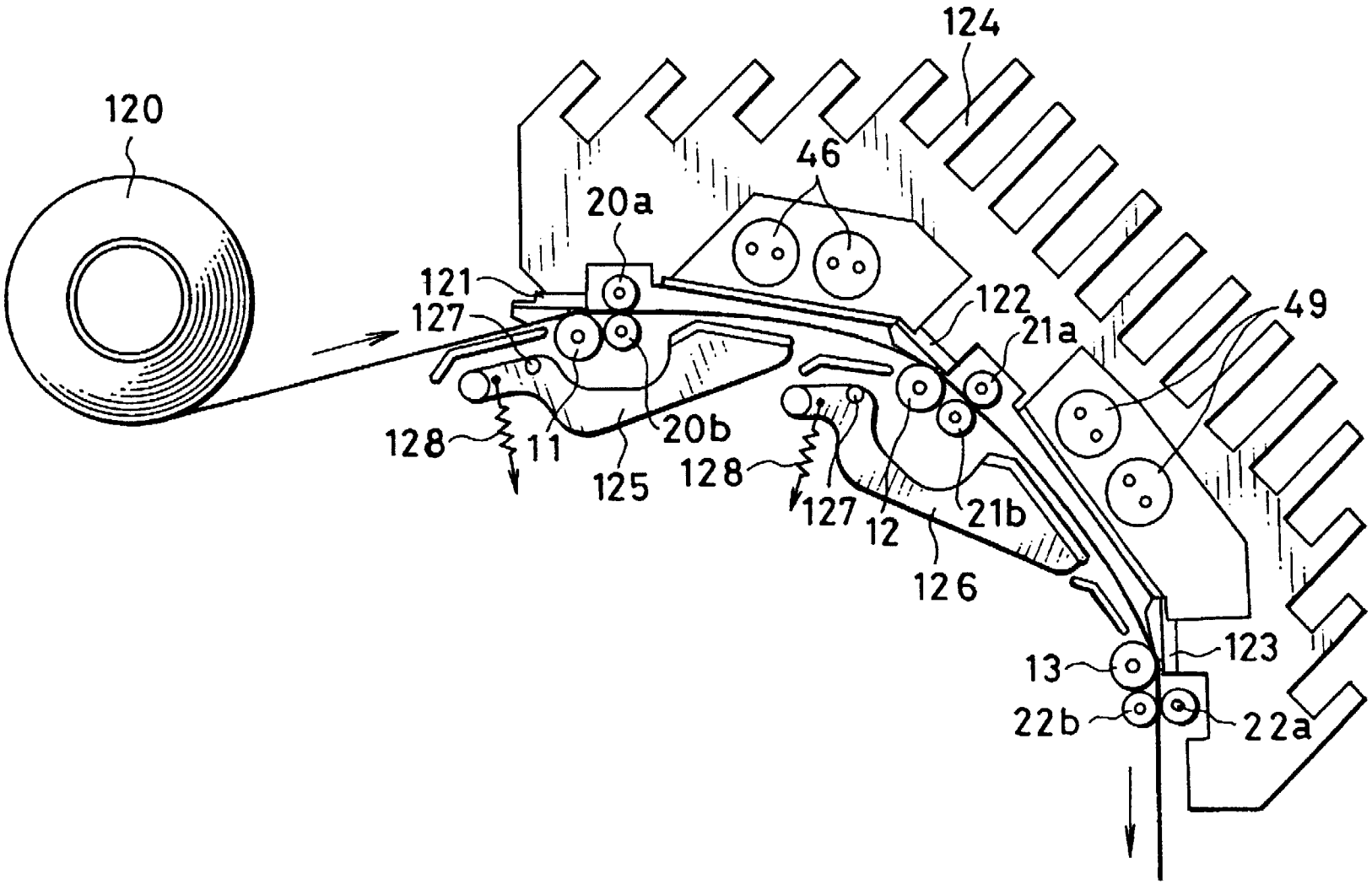
FIG. 7 is a schematic diagram illustrating a direct color thermal printer according to a further embodiment of the present invention, which is straightening the recording material.

FIG. 7 shows another embodiment of the present invention wherein a color thermosensitive recording material 120 is transported along a path which is curved oppositely to the curl of the recording material 120 that is given while it is wound in a roll, as shown in FIG. 7. This embodiment is effective to decurl or straighten the recording material 120 prior to the printing. Also, thermal heads 121, 122 and 123 are secured to a common heat radiator 124 to constitute an integral assembly, so that the positions of the thermal heads 121 to 123 will never change relative to each other by accident. Since the mounting positions of the thermal heads 121 to 123 to the radiator 124 are previously and finely adjustable, the thermal heads 121 to 123 can be easily and quickly positioned in the printer. In intermediate portions between the thermal heads 121 to 123, guide arms 125 and 126 are disposed for loosening the recording material 120. Each of the guide arms 125 and 126 is pivotal about an axle 127, and is gently urged by a coil spring 128 toward the recording material 120 so that the recording material 120 may extend along the curved transport path and may not be tensed between the thermal heads 121 to 123.

Figure 8:
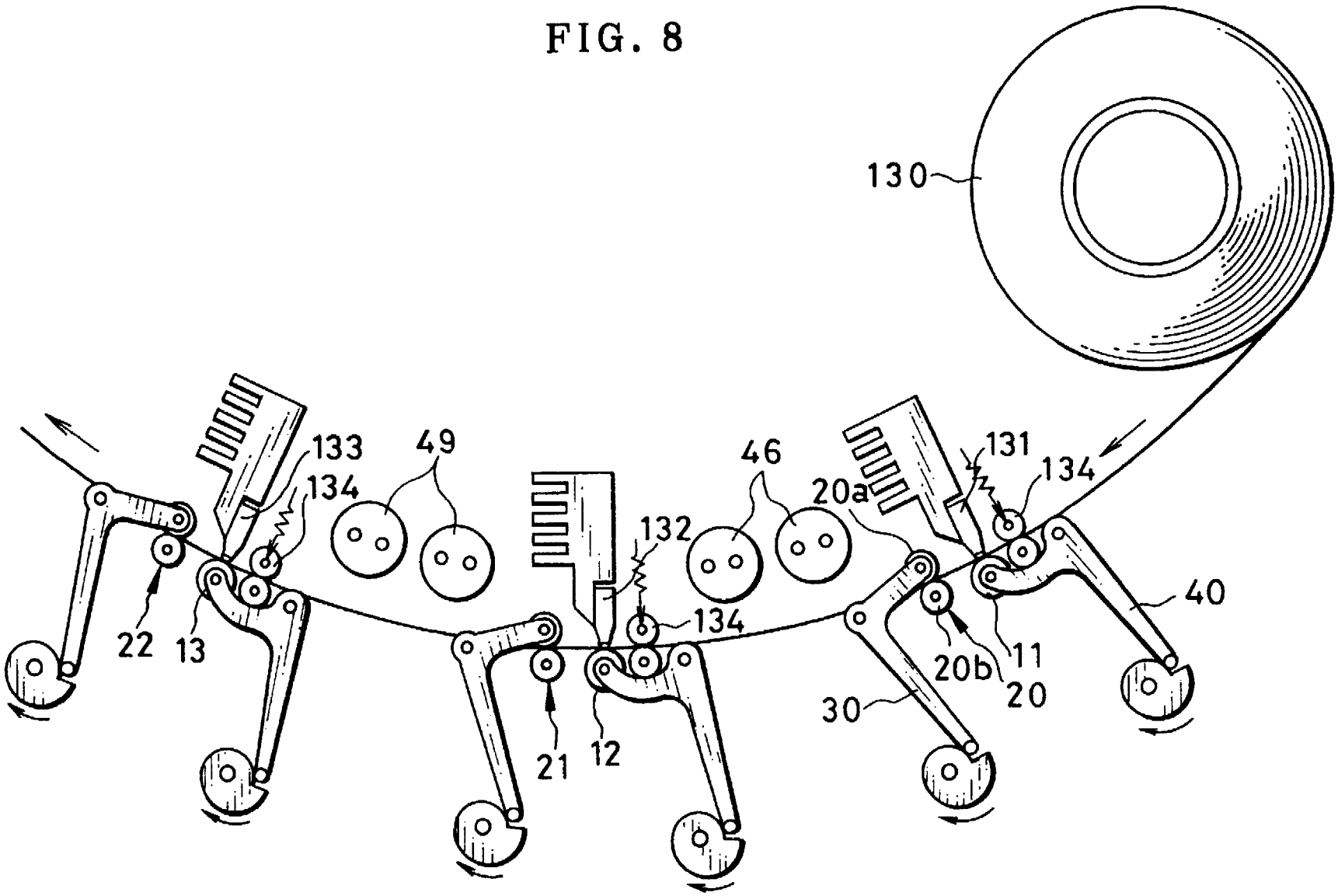
FIG. 8 is a schematic diagram illustrating a direct color thermal printer according to a still another embodiment of the present invention, which is reducing the load on the recording material during transportation.

FIG. 8 shows a further embodiment of the present invention, wherein a color thermosensitive recording material 130 is transported along a path that is curved in the same direction as the curl of the recording material 130 that is given while it is wound in a roll. Although the recording material 130 should be decurled after the printing, this embodiment reduces stress of the recording material 130, prevents paper jam, and enables usage of thin recording materials for the full-color image printing. There are supplementary pinch rollers 134 immediately before respective thermal heads 131, 132 and 133, to gently press to flatten the recording material 130 on recording.

In the embodiments shown in FIGS. 7 and 8, other elements may be equivalent to the first embodiment, so that they are designated by the same reference numbers to avoid redundancy.

In the above described embodiments, the thermal heads are stationary mounted, and the platen rollers are moved up and down, so that the positions of the heating element arrays may not deviate relative to the recording material. By positioning the heating element arrays of the respective thermal heads in the same plane, as shown in FIG. 1, the distortion of the recording material relative to the heating elements is minimized, so that the accurate color registration is achieved. But it is possible to move the thermal heads up and down. The platen rollers may be replaced by platen plates. The recording material may be fed as a sheet having a limited length. The color thermosensitive recording material may have a black recording layer and/or a specific recording layer for a particular color such as a flesh color, in addition to the three color recording layers.

Although the thermal heads 14 to 16 of the first embodiment are spaced equally, the spacing may be changed. For example, when the optical fixing devices have a plurality of ultraviolet lamps to permit a higher speed printing, and the magenta fixing device has a larger number of ultraviolet lamps to radiate a larger amount of optical energy than the optical fixing device for yellow, it is possible to enlarge the magenta fixing area between the magenta thermal head 15 and the cyan thermal head 16, compared with the yellow optical fixing area between the yellow thermal head 14 and the magenta thermal head 15.

It is possible to orient the thermal heads 14 to 16 substantially parallel to the recording material 10, though the thermal heads 14 to 16 are oriented substantially vertical to the recording material 10.

Thus, the present invention should not be limited to the above described embodiments but, on the contrary, various modification may be possible to those skilled in the art without departing from the scope of claims attached hereto.

What is claimed is:

1. A color thermal printer for printing a full-color image on a recording material, comprising a plurality of thermal heads arranged in series along a transport path, each of said plurality of thermal heads recording a particular color frame of the full-color image on the recording material to print the full-color image while said recording material being advanced in a transporting direction at one time through the transport path, said color thermal printer comprising:

a plurality of platens, each being opposed to one of said plurality of thermal heads across the transport path, and movable relative to said opposed thermal head to press said recording material against said opposed thermal head;

a plurality of capstan rollers disposed respectively behind said plurality of thermal heads in the transporting direction of the recording material;

a plurality of pinch rollers, each being opposed to one of said capstan rollers across the transport path, and movable relative to said opposed capstan roller to nip said recording material;

a feed forward mechanism for providing information regarding speed of transport through a thermal head; and driving means for driving said capstan rollers each individually to transport said recording material at an appropriate speed in accordance with said feed forward mechanism through each of said plurality of thermal heads.

2. The color thermal printer as claimed in claim 1, wherein said recording material is previously wound in a roll and is fed from the roll to said transport path, and said transport path is curved oppositely to a curl that is provided in said recording material while wounded in the roll, so as to decurl said recording material.

3. The color thermal printer as claimed in claim 1, wherein said recording material is previously wound in a roll and is fed from the roll to said transport path, and said transport path is curved in the same direction as a curl that is provided in said recording material in the roll.

4. The color thermal printer as claimed in claim 1, wherein said recording material is a color thermosensitive recording material having at least three color thermosensitive recording layers, said color thermosensitive recording layers having heat sensitivities decreasing with distance thereof from an obverse surface of said color thermosensitive recording material, and the color thermal printer further comprises:

a first optical fixing device disposed behind a most upstream one of said plurality of thermal heads in said transporting direction, said first optical fixing device optically fix the most obverse color thermosensitive recording layer after the most upstream thermal head performs recording to the most observe color thermosensitive recording layer; and a second optical fixing device disposed behind a second upstream one of said plurality of thermal heads in said transporting direction, said second optical fixing device optically fix the second obverse color thermosensitive recording layer after the second upstream thermal head performs recording to the second observe color thermosensitive recording layer.

5. The color thermal printer as claimed in claim 1, wherein said plurality of thermal heads are mounted stationary, whereas said platens are mounted movable between an actuating position contacting with said opposed thermal head each and a retracted position away from said opposed thermal head.

6. The color thermal printer as claimed in claim 5, wherein said plurality of thermal heads are securely mounted to a common member to constitute an integral assembly.

7. The color thermal printer as claimed in claim 6, wherein said common member is a heat radiator for cooling said plurality of thermal heads.

8. The color thermal printer as claimed in claim 1, wherein said recording material has a length extending over said plurality of thermal heads, to permit recording said full-color image in one of recording areas disposed successively along said recording material; and wherein said plurality of thermal heads are sequentially pressed onto said recording material prior to starting recording said particular color frames from a leading end of each of said recording areas, and are sequentially removed away from said recording material after terminating recording said particular color frames at a trailing end of said each recording area.

9. The color thermal printer as claimed in claim 8, wherein said feed forward mechanism includes slack forming means for forming a slack in said recording material in an upstream portion of said transport path before each of said plurality of thermal heads.

10. The color thermal printer as claimed in claim 9, wherein said slack forming means comprises said capstan rollers, said driving means and sensors for detecting conditions of said recording material in said transport path, and wherein said driving means controls driving of said capstan rollers based on output signals from said sensors.

11. The color thermal printer as recited in claim 9, wherein said feedback mechanism further includes a detector for detecting an amount of slack formed by said slack forming means.

12. The color thermal printer as recited in claim 11, wherein said driving means drives said capstan rollers in accordance with a detected amount of slack.

13. The color thermal printer as recited in claim 9, wherein said slack forming means includes means for ceasing driving capstan roller while generating slack.

14. The color thermal printer as recited in claim 9, wherein said slack forming means includes means for ceasing driving capstan roller while generating slack.

15. A method for controlling color registration during printing a full color image on a recording material to be advanced in a transporting direction through a plurality of thermal heads arranged along a transport path, said method comprising the steps of:

generating slack in the recording material before each of said plurality of thermal heads;

detecting amount of slack before each of said plurality of thermal heads; and individually controlling a speed of transport of recording material across a thermal head in accordance with a detected amount of slack.

16. The method as claimed in claim 15, wherein said controlling step includes controlling driving of capstan rollers in accordance with the detected amount of slack.

17. A color thermal printer having improved color registration for printing a full color image on a recording material to be advanced in a transporting direction through a plurality of thermal heads arranged along a transport path, said printer comprising:

means for generating slack in the recording material before each of said plurality of thermal heads;

a sensor detecting an amount of slack before each of said plurality of thermal heads; and a controller which individually controls a speed of transport of the recording material across a thermal head in accordance with the amount of slack detected by a respective sensor.

18. The color thermal printer according to claim 17, wherein said controller controls a capstan roller positioned downstream of each thermal head.

* * * * *